United States Patent [19]

McCready

[11] 4,382,825

[45] May 10, 1983

[54] ALKALINE CLEANER FOR FERROUS-BASED METAL SURFACES

[75] Inventor: Newton W. McCready, Newtown Square, Pa.

[73] Assignee: Amchem Products, Inc., Ambler, Pa.

[21] Appl. No.: 281,269

[22] Filed: Jul. 8, 1981

[51] Int. Cl.[3] ..... C23G 1/20; C11D 3/075; C11D 3/08; C11D 3/10

[52] U.S. Cl. ..... 134/2; 134/40; 252/135; 252/156; 252/174.22; 252/DIG. 14

[58] Field of Search ..... 252/135, 156, 174.22, 252/DIG. 14; 134/2, 40

[56] References Cited

U.S. PATENT DOCUMENTS

| | | | |
|---|---|---|---|
| 3,507,798 | 4/1970 | Egan et al. | 252/135 |
| 4,019,998 | 4/1977 | Benson et al. | 252/135 |

FOREIGN PATENT DOCUMENTS

| | | | |
|---|---|---|---|
| 1012488 | 12/1965 | United Kingdom | 252/135 |
| 397536 | 2/1974 | U.S.S.R. | 252/135 |

*Primary Examiner*—Evan K. Lawrence

*Attorney, Agent, or Firm*—Ernest G. Szoke; Henry E. Millson, Jr.

[57] ABSTRACT

An alkaline cleaner, cleaning solutions formed therefrom, and processes for cleaning ferrous-based metal surfaces. The compositions and processes of the invention are especially useful in removing contaminants from the surfaces of drawn and ironed black plate steel containers. The cleaner includes:

(a) from about 20 to about 70% by weight of an alkali metal metasilicate or orthosilicate, or a combination thereof;

(b) from 0 to about 45% by weight of an alkali metal carbonate;

(c) from about 5 to about 30% by weight of an alkali metal phosphate;

(d) from about 2 to about 15% by weight of a surfactant such as nonylphenoxy-(polyethoxy) ethanol; and (e) from about 2 to about 20% by weight of a polyethoxy secondary alcohol.

14 Claims, No Drawings

ALKALINE CLEANER FOR FERROUS-BASED METAL SURFACES

BACKGROUND OF THE INVENTION

Containers currently in widespread use in the foodstuff industry include those made of aluminum or aluminum alloys, and those made of tin-plated ferrous metals.

Tin-plated ferrous metal containers tend to be relatively somewhat expensive due to the high cost of the tin-plate. A need therefore exists for relatively inexpensive unplated black plate steel containers, and such containers are presently under development. In order to form such containers, a process called "drawing and ironing" is used, wherein the steel sheeting is drawn and thinned to provide a cylindrical container of uniform wall thickness.

When the steel sheets used to form the containers are manufactured in the foundry, a protective oil such as cottonseed oil or dioctyl sebacate is placed on both sides of the steel sheets in order to protect the steel surfaces from abrasion when the sheet is rolled up for shipment to the container manufacturing plant.

When the rolled steel sheet is ready for use in the forming of containers, lubricants and other materials are coated onto the surfaces of the steel plates to facilitate the drawing and ironing operation. In particular, as the steel sheet is unrolled, the side of the steel sheet which is to become the inside of the container is coated with an acrylic wax, and the opposite side of the steel sheet, which is to become the outside of the container, is coated with molybdenum disulfide in an acrylic base.

These coating materials are necessary to facilitate the drawing and ironing operation. However, these coating materials are very difficult to remove from the surfaces of the containers, and conventional metal cleaning compositions, used for cleaning aluminum and tin-plated ferrous metal containers, have not proved suitable for removing these coating materials from the black plate steel containers. Removal of the mixture of molybdenum disulfide in the acrylic base has proved to be particularly difficult.

Commercial operations for cleaning containers prior to their further processing and filling with comestibles typically employ spraying operations. The metal containers are placed upside down on a conveyor belt, and the cleaning solution is sprayed into and on all surfaces of the containers. Following this cleaning step, the containers are sprayed with a rinse solution, usually clear tap water followed by deionized water, to remove remnants of the cleaning solution remaining on the surfaces.

Compositions have now been discovered that are useful in cleaning black plate steel containers when conventional spraying (or immersion) cleaning techniques are employed. Following the rinsing step, the containers are free of water breaks, showing that the containers are clean and free of the coating materials employed in their formation.

Prior art alkaline or neutral cleaning compositions for cleaning metal surfaces are disclosed in, e.g., the following patents:

- U.S. Pat. No. 3,975,215 issued Aug. 17, 1976 to Edward A. Rodzewich
- U.S. Pat. No. 3,888,783 issued June 10, 1975 to Edward A. Rodzewich
- Japanese Pat. No. 53,100,131 issued to Asabi Kagaku Kogyo

- Japanese Pat. No. 53,149,130 issued to Nihon Parkerizing
- Japanese Pat. No. 53,045,309 issued to Nissan Motor
- U.S. Pat. No. 4,093,566 issued Dec. 27, 1976 to the United States Secretary of the Army

DETAILED DESCRIPTION OF THE INVENTION

The present invention relates to aqueous cleaning solutions and processes for cleaning ferrous-based metal surfaces, and to compositions useful in formulating such aqueous cleaning solutions.

The compositions of the invention that are conveniently employed in forming the aqueous cleaning solutions of the invention comprise:

(a) from about 20 to about 70% by weight, preferably from about 30 to about 50% by weight, of either an alkali metal metasilicate or an alkali metal orthosilicate, or a combination of such silicates. The silicate is preferably anhydrous, although the pentahydrate of the alkali metal metasilicate can also be employed. The alkali metal salts are preferably the sodium salts, although the potassium or lithium salts can also be used. Anhydrous sodium metasilicate is preferred since it is relatively inexpensive, is quite soluble in water, and provides high alkalinity and good detergency.

(b) from 0 to about 45% by weight, preferably from about 5 to about 35% by weight of an anhydrous alkali metal carbonate, e.g. $Na_2CO_3$ or $K_2CO_3$. A low density alkali metal carbonate, e.g. low density sodium carbonate, is preferred.

(c) from about 5 to about 30% by weight, preferably from about 10 to about 25% by weight, of an anhydrous condensed alkali metal phosphate. The alkali metal phosphate can be either an alkali metal tripolyphosphate, a tetra alkali metal pyrophosphate, an alkali metal hexametaphosphate, or a combination of one or more of the above.

(d) from about 2 to about 15% by weight, preferably from about 3 to about 6% by weight of a compound of the formula

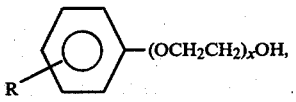

wherein R is a saturated $C_8$–$C_{12}$ alkyl group, and x is in the range of 8 to 12, and having a cloud point (1%) in the range of from about 45° to about 65° C. The $C_{8-12}$ saturated alkyl group can be, e.g. octyl, nonyl, or dodecyl, with nonyl preferred. The preferred compound is nonylphenoxy-(polyethoxy)$_{9-10}$ ethanol, having a cloud point of about 54° C., sold commercially under the trade name "TRITON N-101" by Rohm & Haas Company, "TERGITOL NP-9" by Union Carbide, and "IGEPAL CO-630" by GAF Corporation.

(e) from about 2 to about 20% by weight, preferably from about 4.5 to about 12% by weight of a polyethoxy secondary alcohol of the formula $$C_{12-14}H_{25-29}O(CH_2CH_2O)_x[CH_2CH_2O/CH_2CH(CH_3)O]_yCH_2CH(CH_3)OH,$$

wherein x is in the range of from about 5 to about 9, preferably about 6 to about 8, y is in the range of from about 1 to about 5, preferably about 2 to about 4, and the cloud point is in the range of about 35° to about 45° C. The preferred compound for use in the practice of the invention has a molecular weight of about 706, and is sold commercially under the trade name "TERGITOL MIN-FOAM 1X" by the Union Carbide Corporation.

In the above compositions, the sum of the quantity of ingredient (b) and ingredient (c) must be at least about 15% by weight of the composition. Accordingly, when ingredient (c) is chosen to be less than about 15%, a sufficient quantity of ingredient (b) must be present to equal about 15% or more by weight of the two ingredients. Conversely, when 15% by weight or more of ingredient (c) is selected, the addition of ingredient (b) to the composition becomes optional, although it is still preferred to have from about 5 to about 35% by weight of ingredient (b) present in the composition. Also, it is preferred to have the ratio of ingredient (e) to ingredient (d) in the range of 1.5:1–2:1.

When the above compositions are added to water in an amount of from about 7.5 to about 50 grams/liter, preferably about 10 to about 20 grams/liter, cleaning solutions are formed suitable for use in cleaning the surfaces of ferrous-based metals. These cleaning solutions have a pH in the range of from about 11.5 to about 13.0, preferably in the range of from about 12.2 to about 12.8.

The processes of the invention comprise contacting the ferrous-based metal surface to be cleaned with the above aqueous cleaning solutions using any conventional contacting technique known to the art, but preferably using a spray technique. The temperature of the cleaning composition is maintained in the range of from about 125° F. to about 212° F., preferably from about 140° F. to about 160° F. Contact times can range from about 10 seconds to about 2 minutes, with from about 30 seconds to 45 seconds preferred.

Following the cleaning step, the metal surfaces are rinsed with water to remove adhered cleaning solution. The cleaned metal surfaces may then be further treated with protective coating solutions as desired.

An additional step of pre-rinsing the metal surfaces prior to the cleaning step can optionally be employed using water or a dilute solution of the cleaning compositions of the invention.

When black plate steel containers are cleaned according to the processes of the invention, the cottonseed oil, dioctyl sebacate, acrylic wax and molybdenum disulfide in an acrylic base used in the rolling operation and in the drawing and forming operation are completely removed from the inside and outside surfaces of the container. The acrylic wax and the acrylic base containing the molybdenum disulfide are depolymerized and solubilized in the cleaning solution, and the molybdenum disulfide is suspended in the cleaning solution and thereby removed from the surfaces of the container. When the cleaned containers are rinsed and allowed to stand for 30 seconds, no water breaks occur on the surfaces, showing a high degree of surface cleanliness.

The invention is illustrated by the following examples, which are meant to be illustrative only and not limitative.

EXAMPLE 1

100 grams of a cleaning composition is prepared by mixing together the following quantities of ingredients:

| Ingredient | Quantity |
|---|---|
| anhydrous sodium metasilicate | 35 grams |
| anhydrous sodium carbonate | 33 grams |
| sodium tripolyphosphate | 22 grams |
| TERGITOL MIN-FOAM 1X | 6 grams |
| TRITON N-101 | 4 grams |

EXAMPLE 2

90 grams of the composition of Example 1 is added to 6 liters of tap water, the resulting solution stirred to render it uniform, and the temperature raised to 150° F. A black plate steel can covered with cottonseed oil, acrylic wax on the inside, and $MoS_2$ in an acrylic base on the outside is sprayed for 30 seconds with the above cleaning solution, rinsed in cold tap water by immersion for 30 seconds, and the can allowed to stand for 30 seconds and examined. There are no water breaks on either the inside or outside surfaces and the surfaces appear clean and free of all contaminants.

EXAMPLE 3

100 grams of a cleaning composition is prepared with the following quantities of ingredients:

| Ingredient | Quantity |
|---|---|
| sodium orthosilicate | 50 grams |
| potassium pyrophosphate | 25 grams |
| TERGITOL MIN-FOAM 1X | 15 grams |
| TRITON N-101 | 10 grams |

EXAMPLE 4

90 grams of the composition of Example 3 is added to 6 liters of tap water, the resulting solution stirred, and the temperature raised to 150° F. A black plate steel can contaminated with the same contaminants as in Example 1 is sprayed for 30 seconds with the above cleaning solution, immersed in cold tap water for 30 seconds, and the can allowed to stand for 30 seconds and then examined. There are no water breaks on any surface of the can and the can appears clean and free of all contaminants.

EXAMPLE 5

100 grams of a cleaning composition is prepared with the following quantities of ingredients:

| Ingredient | Quantity |
|---|---|
| anhydrous sodium orthosilicate | 40 grams |
| anhydrous potassium carbonate | 23 grams |
| potassium hexametaphosphate | 25 grams |
| octylphenoxy $(CH_2CH_2O)_{8-10}CH_2CH_2OH$ | 4 grams |
| TERGITOL MIN-FOAM 1X | 8 grams |

EXAMPLE 6

90 grams of the composition of Example 5 is added to 6 liters of tap water and a cleaning bath prepared as in Example 2. A black plate steel can contaminated as in Example 1 is cleaned according to the same procedure used in Example 1. The can is completely free of water breaks and appears clean and free of all contaminants.

I claim:

1. An alkaline cleaner for cleaning ferrous-based metal surfaces comprising:

(a) from about 20 to about 70% by weight of either an alkali metal metasilicate, an alkali metal orthosilicate, or a combination thereof;

(b) from 0 to about 45% by weight of a substantially anhydrous alkali metal carbonate;

(c) from about 5 to about 30% by weight of at least one of a substantially anhydrous (i) alkali metal tripolyphosphate, (ii) tetra alkali metal pyrophosphate, and (iii) alkali metal hexametaphosphate;

(d) from about 2 to about 15% by weight of a surfactant of the formula

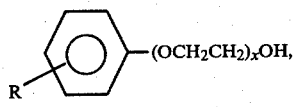

wherein R is a saturated $C_8$–$C_{12}$ alkyl group, x is in the range of 8 to 12, and the surfactant has a cloud point in the range of about 45° to about 65° C.;

(e) from about 2 to about 20% by weight of a polyethoxy secondary alcohol of the formula $$C_{12\text{-}14}H_{25\text{-}29}O(CH_2CH_2O)_x[CH_2CH_2O/CH_2CH(CH_3)O]_yCH_2CH(CH_3)OH,$$

wherein x is from about 5 to about 9, y is from about 1 to about 5, and the cloud point is in the range of about 35° to about 45° C.; wherein the sum of (b) and (c) is not less than about 15% by weight, and wherein an aqueous solution containing from about 10 to about 20 grams/liter of said alkaline cleaner in water has a pH in the range of from about 12.2 to about 12.8.

2. The alkaline cleaner of claim 1 wherein (a) is present in an amount from about 30 to about 50% by weight.

3. The alkaline cleaner of claim 1 wherein (b) is present in an amount from about 5 to about 35% by weight.

4. The alkaline cleaner of claim 1 wherein (c) is present in an amount from about 10 to about 25% by weight.

5. The alkaline cleaner of claim 1 wherein (d) is present in an amount from about 3 to about 6% by weight.

6. The alkaline cleaner of claim 1 wherein (e) is present in an amount from about 4.5 to about 12% by weight.

7. The alkaline cleaner of claims 1, 2, 3, 4, 5, or 6 wherein (a) is sodium metasilicate, (b) is sodium carbonate, (c) is sodium tripolyphosphate, (d) is nonylphenoxy(polyethoxy)$_{9\text{-}10}$ethanol, and in (e), x is from about 6 to about 8, and y is from about 2 to about 4.

8. An aqueous alkaline cleaning solution for ferrous-based metal surfaces comprising from about 7.5 to about 50 grams/liter of the alkaline cleaner composition of claims 1, 2, 3, 4, 5, or 6 in water and wherein said solution has a pH in the range of from about 12.2 to about 12.8.

9. An aqueous alkaline cleaning solution of claim 8 wherein from about 10 to about 20 grams/liter of said composition are present.

10. A process for cleaning a ferrous-based metal surface comprising the steps of (a) contacting said surface with a composition of claim 8 at a temperature in the range of about 125° F. to about 212° F., and for a period of from about 10 seconds to about 2 minutes, and (b) rinsing said surface with water.

11. The process of claim 10 wherein the aqueous alkaline cleaning solution is present in an amount from about 10 to about 20 grams/liter.

12. The process of claim 10 wherein the temperature is in the range of from about 140° F. to about 160° F.

13. The process of claim 12 wherein the surface contact is achieved by spraying and the contact time is in the range of from about 30 to about 45 seconds.

14. The process of claim 10 wherein the ferrous-based metal surface is a black plate steel can.

* * * * *